US005803331A

United States Patent [19]

Thorne et al.

[11] Patent Number: 5,803,331

[45] Date of Patent: Sep. 8, 1998

[54] DOLL SLEEPING BAG STYLE BACK-PACK

[76] Inventors: Jodi L. Thorne, 3 Dogwood Dr., Yardley, Pa. 19067; Kathleen M. Sheehan, 496 Trapp La., Langhorne, Pa. 19047

[21] Appl. No.: 773,104

[22] Filed: Dec. 26, 1996

[51] Int. Cl.[6] ..... A45F 5/00

[52] U.S. Cl. ..... 224/627; 224/645; 224/652; 224/160

[58] Field of Search ..... 224/158, 160, 224/627, 642, 643, 645, 650, 652, 653, 911, 913, 919, 908; D3/215, 216, 217, 213, 214, 221

[56] References Cited

U.S. PATENT DOCUMENTS

| | | | |
|---|---|---|---|
| D. 311,813 | 11/1990 | Oliver | D3/216 |
| D. 334,253 | 3/1993 | Balzarini | D3/214 |
| D. 352,603 | 11/1994 | Maller | D3/221 |
| 995,458 | 6/1911 | Harriman | 224/913 |
| 1,192,344 | 7/1916 | Peterson et al. | 224/627 |
| 3,481,517 | 12/1969 | Aukerman | 224/160 |
| 4,330,073 | 5/1982 | Clark | 224/908 |
| 4,579,264 | 4/1986 | Napolitano | 224/160 |
| 4,693,402 | 9/1987 | Comeau | 224/919 |
| 4,898,310 | 2/1990 | Remington | 224/907 |
| 4,923,104 | 5/1990 | Rice et al. | 224/160 |

FOREIGN PATENT DOCUMENTS

| | | | |
|---|---|---|---|
| 611234 A1 | 9/1994 | European Pat. Off. | 224/160 |
| 2404414 | 6/1979 | France | 224/160 |

*Primary Examiner*—Henry J. Recla
*Assistant Examiner*—Gregory Vidovich
*Attorney, Agent, or Firm*—John J. Simkanich

[57] ABSTRACT

A carrier for doll-type toys is provided having a pocket like enclosure for carrying the doll-type toy in a partially displayed position. The enclosure includes a double wall section forming an envelope or bag, in which the doll-type toy is carried, and a single wall section, against which the doll-type toy is partially displayed. This single wall section extends beyond and above the double walled section. Carrying straps permit the enclosure to be carried on the back of a child, in back-pack fashion. The carrying straps are attached adjacent to the free end of the single wall section and at the side of the double wall section. A second and smaller pocket enclosure may be attached to the front face of the carrier.

15 Claims, 4 Drawing Sheets

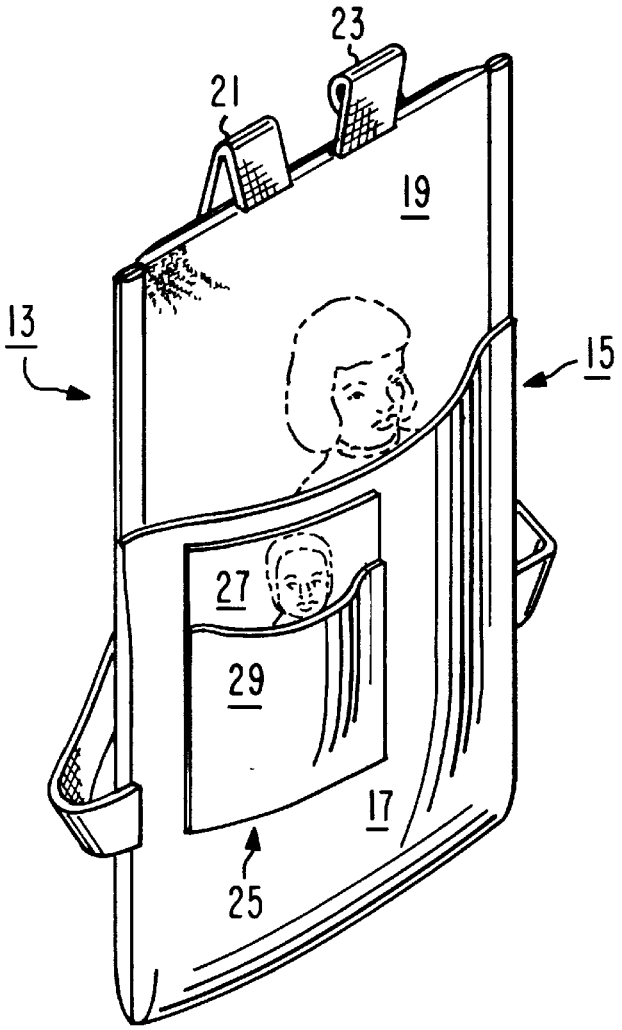
Fig. I
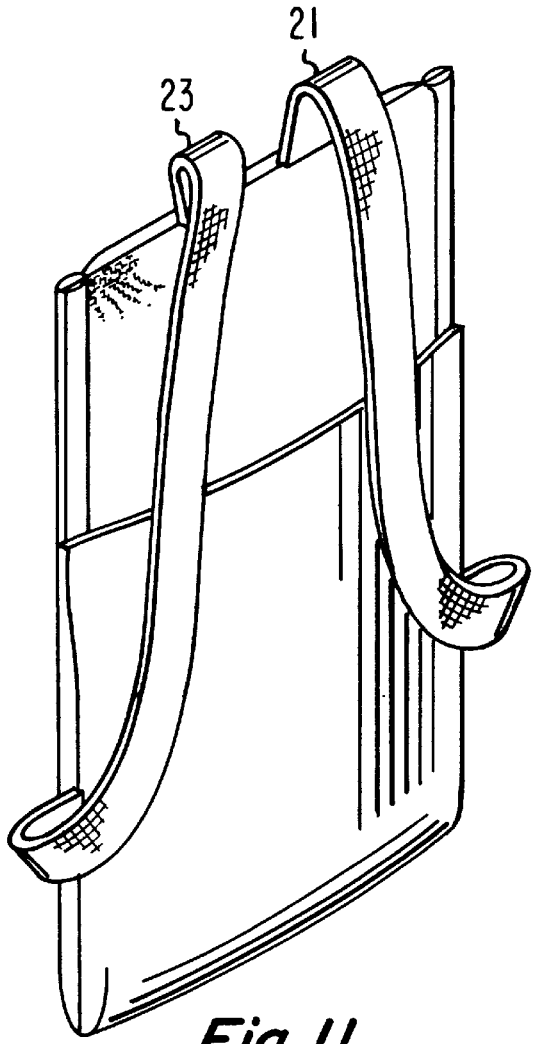
Fig. II

Fig. 5
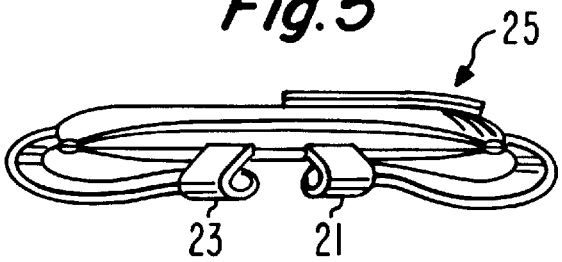
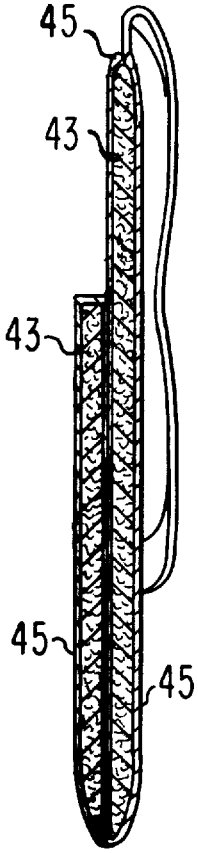
Fig. 9
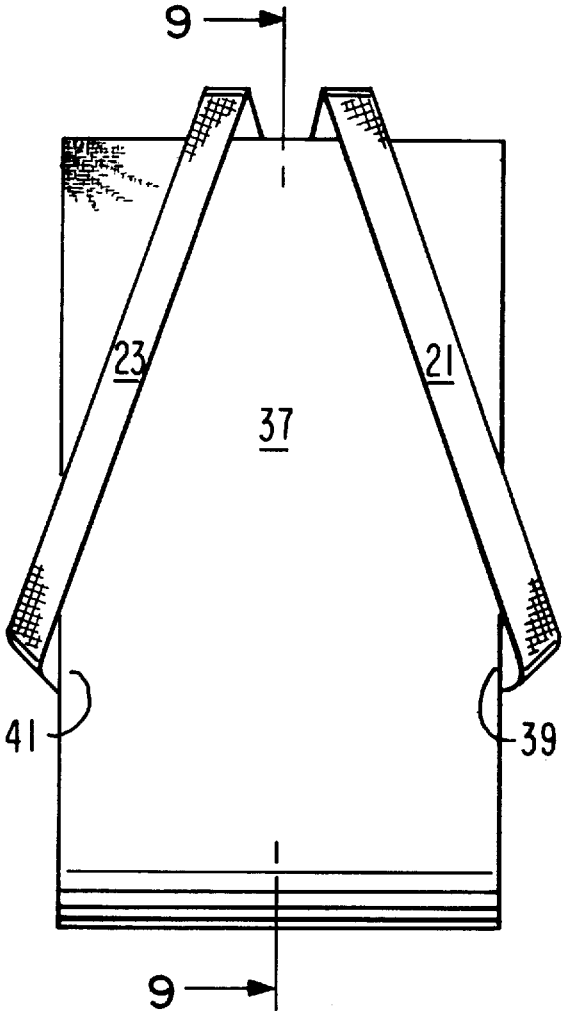
Fig. 6

DOLL SLEEPING BAG STYLE BACK-PACK

BACKGROUND OF THE INVENTION

The present invention is directed to a doll-type toy accessory which can be used as a back-pack carrier for a doll, or as a play sleeping bag for the doll. The invention relates to fabric and flexible plastic carrying devices for toys. It also relates to fabric play sleep wear and accessories for dolls.

Small children, especially girls, often play with dolls and doll-type toys. They want to carry these dolls to friends homes and to school. When carrying such dolls and other objects, the children can fall or drop the doll.

When a child trips or falls while carrying a toy, they often fall on that toy, and either break the toy, or get hurt, or both. When a child drops a doll, the doll can break. Many dolls are quite expensive to replace.

Moreover, children, especially those in the two years to eight years old range, can run, walk and look about much more safely with their hands and front of their bodies free, than when not carrying an toy, especially a reasonably large doll.

An object of the present invention is to provide a doll carrier which is to be worn on the back of a child thereby freeing her(his) hands and arms and the front of her body.

A second object of the present invention is provide this doll back-pack type carrier with sufficient padding to protect the child from injury against the doll, and to protect the doll from breakage, should the child fall.

A further object of the present invention is provide this doll back-pack type carrier with a shape, which will accept the doll in a partial display position and which will hold a sufficient portion of the doll to prohibit the doll from falling from the carrier during normal activity, including walking and running.

An even further object of the invention is to provide the carrier with a shape of a doll accessory, such as a sleeping bag, for use during play with the doll.

SUMMARY OF THE INVENTION

The objects of the invention are realized in a combination doll back-pack carrier and sleeping bag. This back-pack carrier supports the doll in a semi-displayed position, with the doll's head showing and its feet supported against a bottom surface within the carrier. This positioning is maintained on the back of the wearer. The carrier itself is padded and shaped like a sleeping bag, and sized to fit a toy doll.

The invention displays the doll's head while holding the doll's body within the bag. The receiving envelope section of the bag, which holds the body, legs and arms of the doll, is of narrow profile and is deep enough to inhibit the doll from falling out of the carrier during normal activity.

This receiving envelope section of the bag is of double wall construction with a back wall and a front wall. The two walls are sewed or otherwise attached together on three sides to form the receiving envelope. The envelope section back wall forms part of the bottom of the sleeping bag which is also part of the back wall of the back-pack. A pillow or head rest section of the bag extends outwardly from the open edge of the back wall of the envelope section and is contiguous with it. When the bag is worn as a back-pack this head rest section extends upwardly above the envelope section and forms the top section of the back wall of the back-pack carrier.

A plurality of straps are attached to extend from the sleeping bag head rest section to the envelope section. These straps facilitate the sleeping bag being carried on the back of a child. Included are a pair of sling type straps, extending one each on each side of the sleeping bag, from the top edge of the head rest section to the respective side of the envelope section. These straps are worn by the child who slings them over her shoulders, in standard fashion to permit the carrying of the sleeping bag shaped back-pack, on her back.

The sleeping bag part of the back-pack may be made of padded cloth fabric. The fabric may be sewn together to make the structural connections of the invention. The shoulder straps may be made of reinforced fabric material and/or woven web material.

DESCRIPTION OF THE DRAWINGS

The features, advantages and operation of the invention will become readily apparent and further understood from a reading of the following detailed description with the accompanying drawings, in which like numerals refer to like elements, and in which:

FIG. 1 shows a perspective view of the sleeping bag shaped back-pack with doll carried (in phantom);

FIG. 5 is a top elevation of the back-pack of FIG. 1;

FIG. 6 is a back elevation of the back-pack of FIGS. 1 or 3;

FIG. 9 is a cross sectional view through the back-pack and taken as shown in FIG. 9;

FIG. 11 is a perspective view of the second embodiment of the invention shown in FIG. 3.

DETAILED DESCRIPTION OF THE INVENTION

Figure 7:
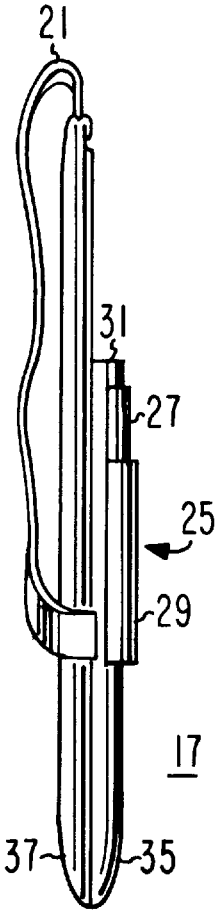
FIG. 7 is a left side elevation of the back-pack of FIG. 1 with the right side elevation being a mirror image.

The present invention is a back-pack carrier for dolls and the like, which is shaped like a sleeping bag. The walls of the bag are made of a flexible material which includes padding. The entire structure may be washed or dry cleaned. This sleeping bag structure for the back-pack provides a doll accessory play thing (sleeping bag) when not used as a carrier, and is an attractive display device with the head of the doll showing, when used as a back-pack carrier. There are no ties, cover flaps or snaps need to contain the doll in the carrier. The doll is carried vertically in an envelope section.

The back-pack carrier 13 is shaped like a sleeping bag 15 with an envelope section 17 and a head rest section 19, FIG. 1. The overall shape of the sleeping bag 15 is elongate rectangular, but can alternately be made in mummy or other sleeping bag shapes, and remain within the scope of the invention. The dimensions of the sleeping bag 15 and each of its sections 17, 19 can vary with the size of the child wearing the carrier 13, and with the size of the doll to be carried. However, only about two or three different sizes are needed as smaller children will want to tote larger sizes, like their larger child counterparts. Typically, the overall dimensions of the sleeping bag 15 are within certain ranges: 12 to 18 inches wide and 15 to 27 inches long. The head rest section 19 is the same width as the envelope section 17, and comprises about 25 to 30 percent of the overall height of the bag 15.

The width of the sleeping bag 15 is uniform along its length, including its head rest section 19 and its envelope section 17, therebelow. The width of the envelope 17 is chosen to be about 1.75 to 3.0 times the widest measurement across the doll carried in the envelope section 17. Furthermore, the length of the envelope 17 is about 75 to 85 percent of the height of the doll carried. This size will permit a doll to be inserted to a depth in an approximate range of its upper chest to neck, with the remaining upper portion of the doll extending above the envelope section 17. This allows a sufficient mass of the doll to be within the envelope section 17 to keep the doll generally from riding or bouncing out.

A pair of carrying straps, 21, 23 are sewn into the free end top edge of the of the head rest section 19 of the bag 15 and extend downward therefrom. A respective one of each strap 21, 23 has its other end sewn into a respective one of the outer edges of the envelope section 17, at about mid length.

A decorative pocket 25, maybe sewn onto the front face of the envelope section 17. This decorative pocket 25 has a rectangular back face 27 and a rectangular front face 29. The width of the pocket front and back faces 29, 27 is identical or similar. The length (or height) of the pocket front face 27 is about 25 percent shorter than the pocket back face 27. The shape of the pocket 25 is similar to the sleeping bag 15 and is intended to mimic its looks, with an envelope portion and a head rest portion extending above. A smaller doll or baby doll and implements, such as comb, hair brush, bottle and the like, can be carried in the decorative pocket 25.

The decorative pocket 25 can be about the size of a large work shirt pocket and can be used to hold a decorative handkerchief or floral arrangement, among other things.

Figure 2:
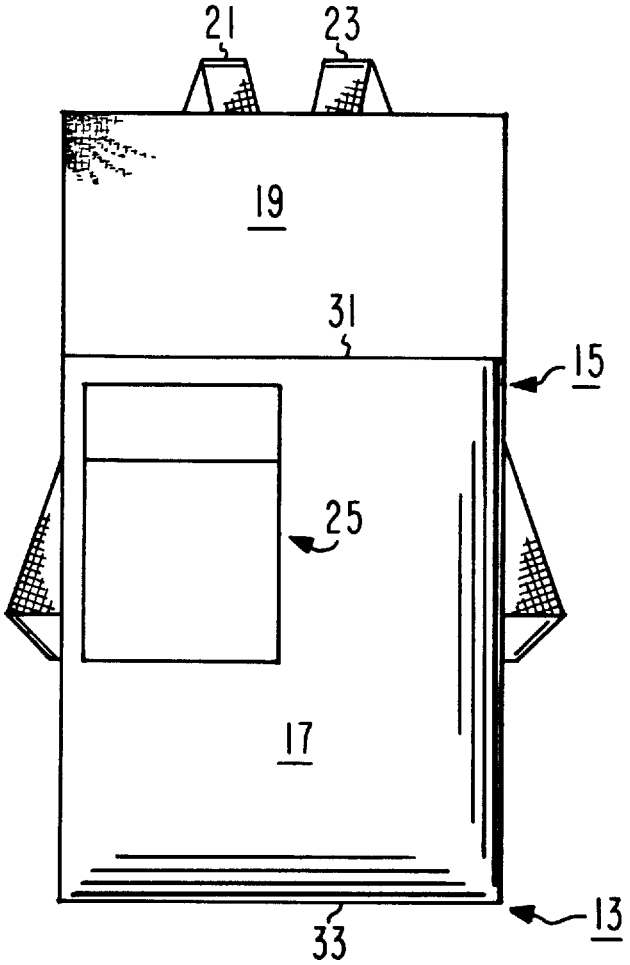
FIG. 2 is a front elevation of the back-pack of FIG. 1.

FIG. 2, is a flat front elevation of the invention 13, which shows the relative sizing and positioning of the head rest section 19, the envelope section 17 below, and the decorative pocket 25 mounted on one side of the front face of the envelope section 17. The decorative pocket 25 provides the look of a smaller sleeping bag mounted onto a large sleeping bag.

The carrying straps 21, 23 are sling type. Each strap 21, 23 is sewn to the (upper most) top edge of the head rest section 19, at a position of from about one inch to about two and one-half inches offset from the vertical centerline of the sleeping bag 15. These dimensions were selected as being standard for child sized back-packs. The carrying straps 21, 23 can be woven web type of nylon or similar stranded fibers, or can be of reinforced fabric, with internal padding at shoulder rest regions. The sling strap widths are in a range from about one inch to about two inches wide. This is typical for back-pack straps. When the opposite ends of each sling strap 21, 23 is sewn into the outer edge of the envelope section 17, as described above, the sling straps are each canted about 30 degrees from vertical.

The sleeping bag 15 has generally straight lines, including the upper edge 31, FIG. 2 (or 31*a*, FIG. 3) of the envelope section 17. These straight lines are carried into the alternate embodiment shown in FIG. 3. This embodiment shows the identical sleeping bag shaped back-pack as the first embodiment, FIG. 2, without the decorative pocket 25 of FIG. 2.

Figure 8:
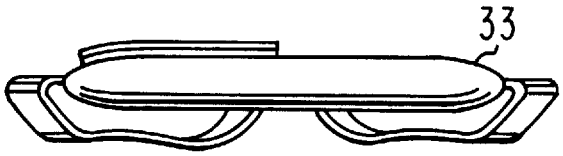
FIG. 8 is a bottom elevation of the back-pack of FIG. 1.

The back-pack 13, sleeping bag 15 structure is about two to three inches thick and has rounded edges and corners. FIG. 4 shows the bottom edge 33*a* of FIG. 3, while FIG. 8 shows the bottom edge 33 of FIG. 2. The sleeping bag 15 is made from a rectangular piece of filled or insulated material doubled over on itself, to form the envelope section 17, when sewn together at the sides. The bottom edge 33, FIG. 8 (or 33*a*, FIG. 4) is seamless and will spread to accommodate a bulky object held within the envelope 17 (17*a*).

Figure 10:
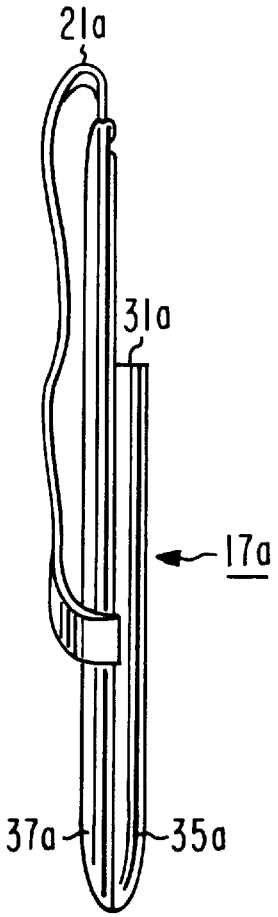
FIG. 10 is a left side elevation of the back-pack of FIG. 3 with the right side elevation being a mirror image.
Figure 3:
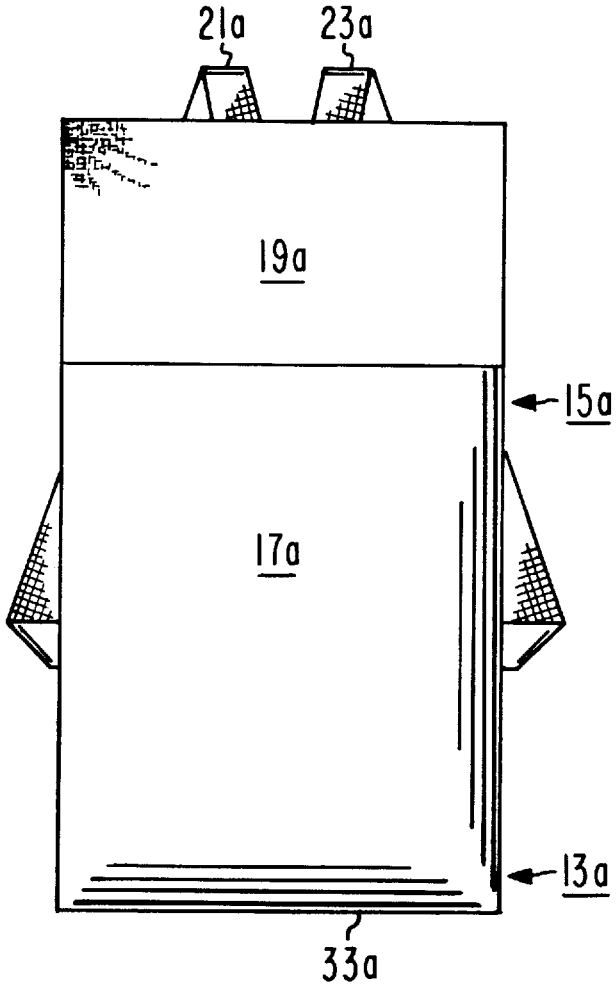
FIG. 3 is a front elevation of an alternate embodiment (without second pocket) of the back-pack of FIG. 1.
Figure 4:
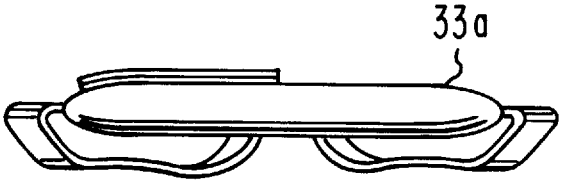
FIG. 4 is a bottom elevation of the back-pack of FIG. 1.

FIG. 7 shows a left side view of the principal embodiment of FIG. 2, while FIG. 10 shows a left side view of the alternate embodiment of FIG. 3. The sling straps 21, 23 (or 21*a*, 23*a*) each have a slack in the range of about 4 to about 10 inches to allow the straps 21, 23 to fit about the shoulders and body of the wearer.

The width of the front wall 35, FIG. 7, of the envelope section 17, being made from the same continuous piece of material, is the same width as the width of the back wall 37 of the envelope section 17. The envelope section 17 of the sleeping bag 15 carrier 13, therefore, is able to accommodate the bulk of a doll by giving way when being pulled out of the flat position. The fabric of the front and back walls 35, 37 pulls against the bottom attachment positions 39, 41 of the sling straps 21, 23, respectively. The envelope section 17, head rest section 19, and the sling straps 21, 23 may each be covered by a similar fabric.

When the back-pack carrier 13 is worn, the weight on the sling straps 21, 23 pulls against the attachment positions 39, 41 tending to create a taunt region horizontally across the envelope section 17, which in turn aids in keeping the doll within the carrier 13 during normal activity. The weight of the carrier 13 on the sling straps 21, 23 also acts to keep the head rest section 19 fully extended above the envelope section 17 in the vertical display position.

The flat back wall 37, FIG. 6, is free of all obstructions and will bulge slightly under the bulk of a doll. A vertical cross-section through the sleeping bag 15, sections 17 and 19, is shown in FIG. 9. The sleeping bag 15 walls are constructed of poly ethylene or poly propylene batting in the range of three-eighths to three quarters inch thick. This synthetic material is very light and hydrophobic. It is washable and will dry quickly. The batting 43 is encased (i.e., covered) with a fabric 45. The weight, material and pattern for this fabric is a matter of choice. Eight to ten ounce cotton twill, fifteen ounce rip-stop nylon, and other durable materials are acceptable.

The weight, density and the character of the material of manufacture of both the batting 43 and the covering fabric 45 will determine the durability the carrier 13 and its overall weight. Both durability and weight are factors in children's play things.

A closed cell, low to medium density, foam may be substituted for the batting 43. A plastic covering may be substituted for the fabric 45. This construction would make the carrier 13 easier to wipe clean, but create a structure which is not as limp as the structure made from the batting 43 and fabric 45 construction.

FIG. 11 shows a perspective view of the alternate embodiment 13*a* of the carrier with the straps 21*a*, 23*a* turned to the reverse side, for carrying the carrier over the arm in pocket book fashion. Whenever the carrier is supported by the sling straps, the head rest section remains fully extended above the envelope section.

When not in use as a carrier, the invention is readily used as a toy sleeping bag which emulates the slumber bags used by children at slumber parties and nursery school. This dual use is possible because the entire carrier structure is made from flexible materials.

Many changes can be made in the above-described invention without departing from the intent and scope thereof. As an example, the pair of sling straps could be implemented with a single strap, starting and terminating at the upper most top edge of the head rest section 19. A loop or slip ring could be secured at each attachment point mid-height on the outside edge of the envelope enclosure section 17. The single strap or belt would pass through the pair of loops and across the envelope 17, like a belt.

It is therefore intended that the above description be read in the illustrative sense and not in the limiting sense. Substitutions can be made in the depth and dimensions stated above and for the wear and other tolerances rendered thereby.

What is claimed is:

1. A sleeping bag and display carrier for dolls, comprising:

an envelope shaped flexible enclosure portion being open on an upper side thereof, said enclosure portion having a back wall and a front wall;

a flexible head rest portion extending above the flexible enclosure portion and being connected thereto on the back wall thereof, said headrest portion having an opposing free end having a top edge and said carrier having an overall height defined by a bottom of the enclosure portion and the top edge of the headrest portion; and a plurality of carrying straps each extending between the top edge of the free end of the flexible head rest portion and a respective outer edge of the flexible enclosure portion, said carrying straps acting to keep the flexible head rest portion extended above the flexible enclosure portion when said carrier is hung by said straps;

whereof said straps are of sufficient length to carry said flexible head rest portion and said connected flexible enclosure portion on one's back;

whereof said flexible head rest portion has a uniform width and is the same width as said flexible enclosure portion and is about 25 to 30 percent of the overall height of the carrier;

and whereof said carrier is usable as a doll sleeping bag when not in use as a carrier.

2. The carrier of claim 1 wherein said flexible enclosure portion has essentially a flat profile, with said front wall and said back wall each being padded and being of equal width, being joined at the sides and the bottom thereof.

3. The carrier of claim 2 wherein said flexible head rest portion is padded and extends upwardly contiguously from said flexible enclosure portion back wall.

4. The carrier of claim 3 wherein said plurality of carrying straps is a pair of carrying straps, extending one each from a proximity near the center of the width of said carrier at the top edge of the free end of said flexible head rest portion to an intermediate point on a respective outer edge side of said flexible enclosure portion.

5. The carrier of claim 4 wherein said flexible enclosure portion is of a depth to substantially but partially accept a doll and hold it therein, said doll being insertible into said flexible enclosure from the upper side thereof.

6. The carrier of claim 5 wherein said padded front and back walls of said flexible enclosure portion are each from ⅜ to ¾ inches thick; wherein said padded flexible head rest portion is likewise from ⅜ to ¾ inches thick; and wherein a portion of a doll not held within said flexible enclosure portion is displayed on said head rest portion.

7. The carrier of claim 6 wherein said pair of straps are attached to said flexible enclosure portion at said respective outer edges thereof at a point at about mid-height of said flexible enclosure portion.

8. The carrier of claim 7 wherein said pair of straps are each attached to and terminate at said flexible head rest portion at the top edge of the free end thereof and adjacent to the vertical centerline of said carrier, said attachment to said top edge of the free end for each strap being canted in the direction of said respective outer edge of said flexible enclosure portion where said respective strap each terminate.

9. The carrier of claim 1 wherein said flexible enclosure portion back wall is of the same thickness as said head rest portion.

10. The carrier of claim 9 wherein said flexible enclosure portion, said head rest portion and said pair of carrying straps are each covered by similar fabric.

11. The carrier of claim 8 also including a pocket on the face of the front wall of said flexible shaped enclosure portion.

12. The carrier of claim 11 wherein said pocket includes a front face and a back face, said back face extending above and beyond said front face.

13. A doll sleeping bag being adaptable into a doll carrier, comprising:

a flexible sleeping bag back wall being of covered padded material;

a flexible bag front wall being of covered padded material and attached to said flexible sleeping bag back wall at the bottom and sides thereof defining a front wall attachment area, said flexible bag front wall being shorter than said flexible sleeping bag back wall to expose a portion of that back wall against which the head of a doll can rest when said doll is inserted between said flexible bag front wall and said flexible sleeping bag back wall wherein the width of said back wall is uniform;

a pair of carrying straps extending from the outermost end of said flexible sleeping bag back wall away from said flexible bag front wall attachment area thereof, and extending to side edges of said flexible sleeping bag back wall, one to each respective adjacent edge, and being attached at an intermediate point along the attachment area of said flexible sleeping bag back wall with said flexible bag front wall below a horizontal mid-line axis of said back wall.

14. The doll sleeping bag of claim 13 wherein the width of said front wall and said back wall are the same, wherein the length of the front wall is from 25 to 30 percent shorter than the back wall, and wherein the attachment of said front wall and said back wall creates a flat envelope enclosure.

15. The doll sleeping bag of claim 14 wherein said carrying straps attachment causes a stress across said bag front and rear walls tending to draw them together when said sleeping bag is supported by said carrying straps and carried thereby on one's back.

* * * * *